US009854907B2

(12) United States Patent
Best

(10) Patent No.: US 9,854,907 B2
(45) Date of Patent: Jan. 2, 2018

(54) PIVOTABLE SUPPORT FOR CLOTHING ARTICLES

(71) Applicant: Theodore Best, Garnerville, NY (US)

(72) Inventor: Theodore Best, Garnerville, NY (US)

( * ) Notice: Subject to any disclaimer, the term of this patent is extended or adjusted under 35 U.S.C. 154(b) by 0 days.

(21) Appl. No.: 14/680,682

(22) Filed: Apr. 7, 2015

(65) Prior Publication Data

US 2016/0296011 A1 Oct. 13, 2016

(51) Int. Cl.

| | |
|---|---|
| ***A47B 61/00*** | (2006.01) |
| ***A47B 49/00*** | (2006.01) |
| ***A47G 25/74*** | (2006.01) |
| ***A47G 25/06*** | (2006.01) |

(52) U.S. Cl.

CPC ..... *A47B 61/003* (2013.01); *A47B 49/00* (2013.01); *A47B 49/008* (2013.01); *A47G 25/0685* (2013.01); *A47G 25/743* (2013.01); *A47G 25/746* (2013.01)

(58) Field of Classification Search

CPC ..... A47G 25/0664; A47G 25/06; A47G 25/0685; A47G 25/743; A47G 25/746; A47G 25/1457; A47B 61/003; A47B 61/02; A47B 49/008; A47B 49/00; A47F 7/24; A47F 5/0087; A47F 7/19; A47F 5/0006; A47F 5/0815; D06F 57/12; D06F 59/02

USPC ..... 211/96, 85.3, 168, 163, 116, 165, 1.53, 211/113, 119.004, 87.01, 99, 100, 103, 211/101, 102, 94.01, 94.03, 95; 223/DIG. 1, 85

See application file for complete search history.

(56) References Cited

U.S. PATENT DOCUMENTS

| | | | | | |
|---|---|---|---|---|---|
| 527,003 | A * | 10/1894 | Nicholas | A47G 25/746 | 211/85.3 |
| 722,279 | A * | 3/1903 | Brackbill | A47F 5/02 | 211/163 |
| 842,940 | A * | 2/1907 | Clark | A47G 25/746 | 211/105 |
| 1,089,882 | A * | 3/1914 | Thomas | A47G 25/0685 | 211/87.01 |
| 1,236,266 | A * | 8/1917 | Chaikin | A47G 25/0685 | 211/106 |
| 1,278,790 | A * | 9/1918 | Thunell | 211/1.3 | |
| 1,711,587 | A * | 5/1929 | Brunhoff | A47F 5/02 | 211/163 |
| 1,742,164 | A * | 12/1929 | Berke | A47F 5/02 | 211/107 |
| 2,076,522 | A * | 4/1937 | Anderson | A47F 5/0876 | 211/165 |
| 2,131,990 | A * | 10/1938 | Tisdale | A47K 10/04 | 211/96 |
| 2,485,201 | A * | 10/1949 | Jewett | A47G 25/746 | 116/63 P |
| 2,613,931 | A * | 10/1952 | Singer | A63H 13/20 | 211/1.55 |

(Continued)

*Primary Examiner* — Joshua Rodden
*Assistant Examiner* — Hiwot Tefera
(74) *Attorney, Agent, or Firm* — Leason Ellis LLP

(57) ABSTRACT

An assembly for holding a plurality of clothing articles includes a first mount that is configured to be fixedly attached to a support surface and at least one pivotable support that is pivotally attached to the first mount. Each pivotable support has a first face and an opposite second face. Each of the first and second faces is configured to receive and hold at least one hook element for holding one or more clothing articles along the respective first or second face.

15 Claims, 7 Drawing Sheets

(56) References Cited

U.S. PATENT DOCUMENTS 2,975,907 A * 3/1961 Hirsch ..... A47G 25/0685 211/104
2,987,193 A * 6/1961 Pajor ..... A47G 25/0685 211/89.01
2,988,230 A * 6/1961 Reibold ..... A47G 25/0685 211/48
3,635,352 A * 1/1972 Brooks ..... A47F 5/05 211/168
3,825,127 A * 7/1974 Morrison ..... A47G 25/0685 16/223
4,126,231 A * 11/1978 Derwent-Wryde ..... B42F 15/00 108/29
4,611,721 A * 9/1986 Heckaman ..... A47G 25/746 211/100
4,805,784 A * 2/1989 Solheim ..... A47F 5/0846 211/59.1
4,997,116 A * 3/1991 Grim ..... B60R 9/06 211/18
5,107,996 A * 4/1992 Whittaker ..... A47G 25/1457 211/113
5,139,155 A * 8/1992 Laxson ..... A47F 5/0087 211/169
5,143,231 A * 9/1992 Chang ..... A47B 61/003 211/168
5,423,435 A * 6/1995 Pollard ..... A47F 7/08 211/163
5,501,378 A * 3/1996 Kolton ..... A47G 25/743 223/85
5,535,896 A * 7/1996 Morgan, Sr. ..... D06F 57/12 211/168
5,620,118 A * 4/1997 Kolton ..... A47G 25/743 223/85
6,065,618 A * 5/2000 Stetler ..... A47G 25/0664 211/168
6,089,423 A * 7/2000 Ellzey ..... A47G 25/743 223/85
6,196,398 B1 * 3/2001 Lowe ..... A47B 61/003 211/87.01
6,582,096 B1 * 6/2003 Searer ..... A47B 61/003 211/105.1
7,946,543 B2 * 5/2011 Cotter ..... A47B 61/00 211/1.53
2006/0213937 A1 * 9/2006 Fife ..... A47G 11/006 223/85
2009/0057166 A1 * 3/2009 Nelson ..... A47G 25/14 206/6.1

* cited by examiner

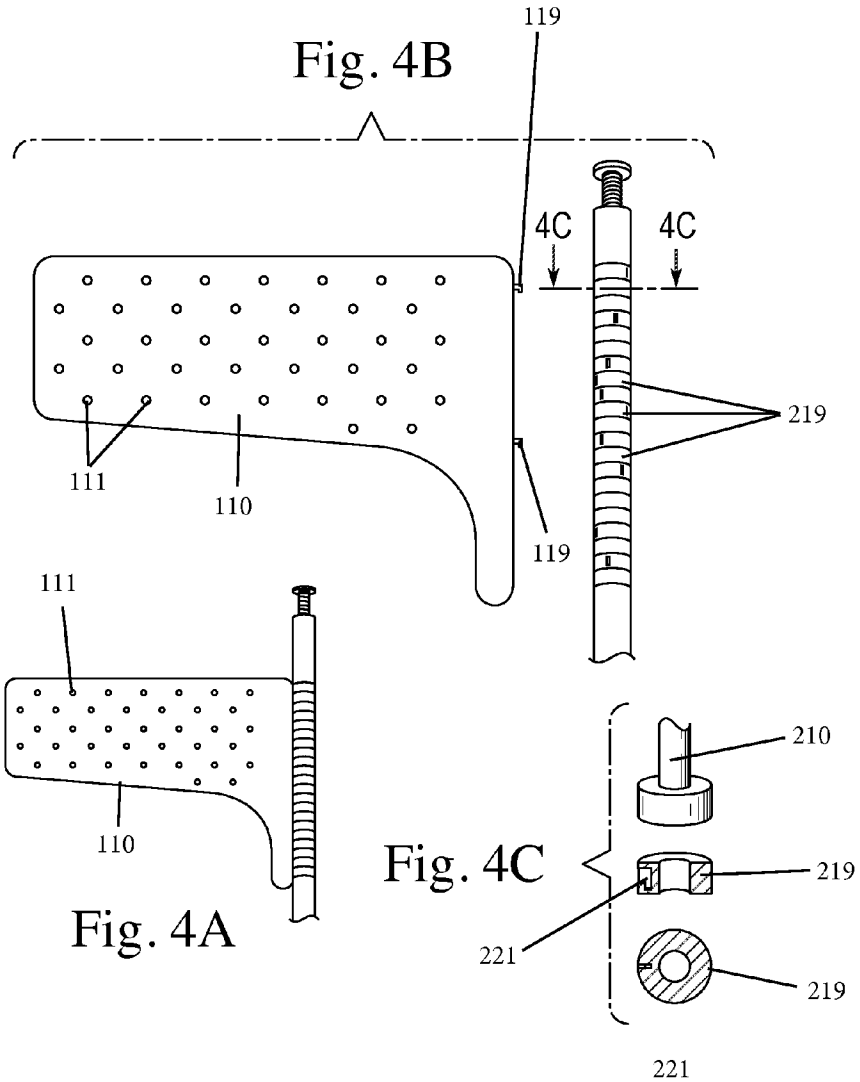
Fig. 4B
Fig. 4C
Fig. 4A
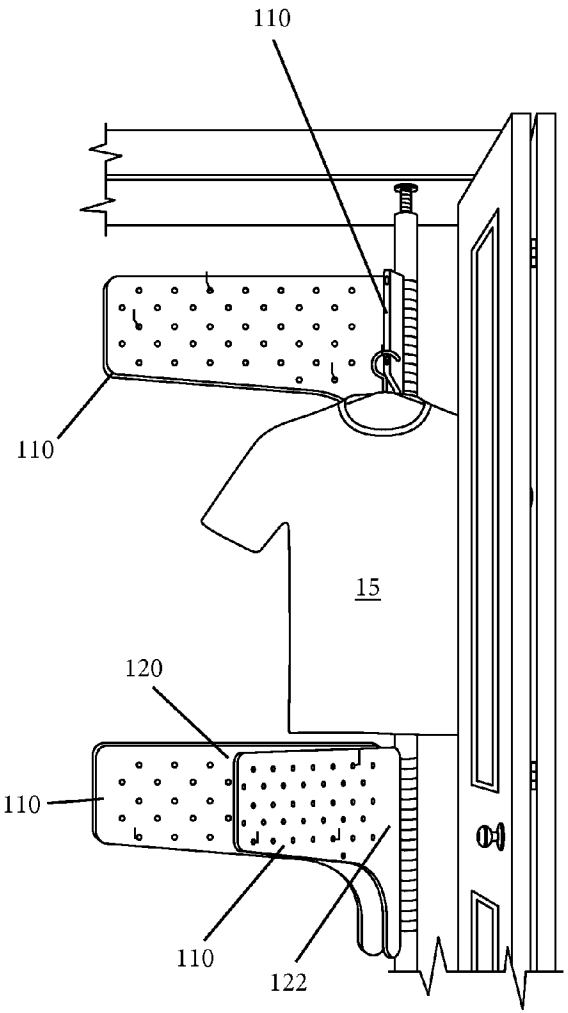
Fig. 3

PIVOTABLE SUPPORT FOR CLOTHING ARTICLES

TECHNICAL FIELD

The present invention relates to a system for organizing items and more specifically, relates to a system for organizing items, including clothing, that includes a pivotable support and is configured for mounting to a support structure, such as a wall or ceiling of a closet.

BACKGROUND

A number of different types of organizers are known in the art for storing and organizing items, such as garments and shoes. The organizers can take the form of a non-permanent, flexible organizer that is installed (mounted) in a target space, such as a closet, or can take the form of a permanent organizer that is mounted in the target space (e.g., closet) as a fixture. Such organizers generally include a plurality of storage compartments having either vertically or horizontally arranged shelves on which articles are stored.

When the organizer is in the form of a non-permanent organizer, it can be of the type that is formed of a flexible material and can be of the type that is hung from a support structure, such as a closet rod. These types of solutions tend to be of the type in which shoes and other smaller articles are stored and hung on the closet rod besides other clothing.

The organizers can be formed of a plurality of separate parts that are either maintained in separate locations and are not coupled to one another or the separate parts can be coupled to one another to form a larger organizer.

With respect to hanging clothing, most closets and most organizers are arranged such that they include a closet rod which extends between two opposing walls of the closet. The rod can be made of metal, wood, plastic or some other rigid material and is constructed to hold the weight of the clothing. The clothing is hung on this rod on hangers or the like which have hooks to hang on the rod. The clothing is thus hung in planes that are perpendicular to the longitudinal axis of the closet rod. The cloths are stacked side-by-side in intimate relationship with one another; however, this manner of arranging clothing results in inefficiencies by its nature.

It will also be understood that clothing is not limited to being just stored or displayed in a closet but instead can be stored or displayed in other settings, such as a retail store or another room or space.

Accordingly, there is a need for an organizer that can be easily installed into an existing closet and is constructed to hold more clothing and display it to the user in a more useful way.

SUMMARY

An assembly for holding a plurality of clothing articles in accordance with one embodiment of the present invention includes a first mount that is configured to be fixedly attached to a support surface and at least one pivotable support that is pivotally attached to the first mount. Each pivotable support has a first face and an opposite second face. Each of the first and second faces is configured to receive and hold at least one hook element for holding one or more clothing articles along the respective first or second face.

BRIEF DESCRIPTION OF THE DRAWING FIGURES

FIG. 3 is a front perspective view of a portion of a system that includes a plurality of pivotable supports and showing pivoting of the plurality of pivotable supports;

FIG. 4A is a side view of one pivotable support mounted to a pole;

FIG. 4B is an exploded view of the pivotable support and the pole;

FIG. 4C is a cross-sectional view taken along the line 4C-4C of FIG. 4B;

DETAILED DESCRIPTION OF CERTAIN EMBODIMENTS

Figure 1:
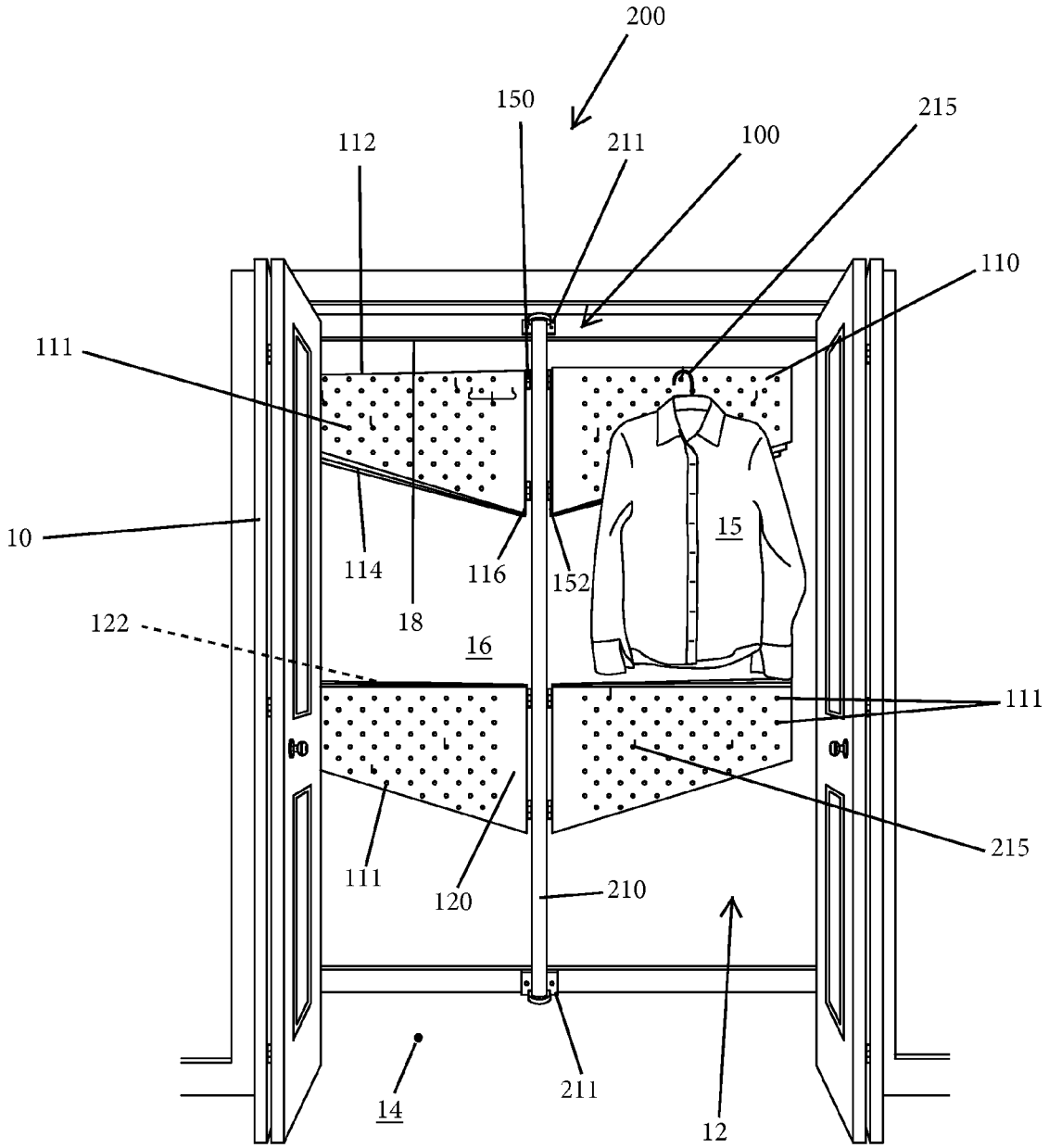
FIG. 1 is front perspective view of a system that includes at least one pivotable support for clothing articles installed in a closet according to a first embodiment.

Now referring to FIGS. 1-4C, the present invention is directed to a pivotable support 100 for clothing articles and can be part of an organizer system (kit) (assembly) 200 that can be mounted in a wide number of different settings including a conventional closet, a retail store or any other space that has a support structure, such as a wall or ceiling, etc., to which the pivotable support 100 can be mounted.

For purpose of illustration only, the pivtotable support 100 is shown as being part of an organizer system 200 that is mounted in a closet 10; however, it will be appreciated that the pivotable support 100 can be installed in other settings as mentioned herein. As a result, the placement of the pivotable support 100 in closet 10 is merely exemplary. Closet 10 is of a conventional design and includes a walk-in entrance that leads into an enclosed space 12. The enclosed space 12 is defined by a floor 14, a plurality of walls 16 and a ceiling 18. Walls 16 are often formed of wood, drywall or other similar material. Ceiling 18 can be formed of similar materials or can be formed of concrete or the like. When drywall is used, it is typically attached to underlying wood studs.

In accordance with the present invention, the pivotable support 100 for clothing article (or other articles which are intended to be hung) includes a base support 110 that is operatively coupled to a hinge or mount 150 such that the base support 110 can pivot relative to the hinge/mount 150. The base support 110 can have a generally triangular shape defined by a top edge 112, an opposing bottom edge 114 and an inner edge 116. The base support 110 also includes a first face 120 and an opposing second face 122. In one exemplary embodiment, the top edge 112 is generally planar and intended to be positioned (mounted) such that it is parallel to the floor 14. The inner edge 116 can be thought of as being a vertical edge relative to the floor 14. The inner edge 116 can be constructed to mate with the hinge 150 in such a way that the base support 110 pivots relative to the hinge 150. The inner edge 116 thus can include a structure that is configured to receive a hinge pin 151 or the like to pivotally couple the base support 110 to the hinge 150. In one embodiment, each pivotable support 100 includes two or more hinges.

Figure 2:
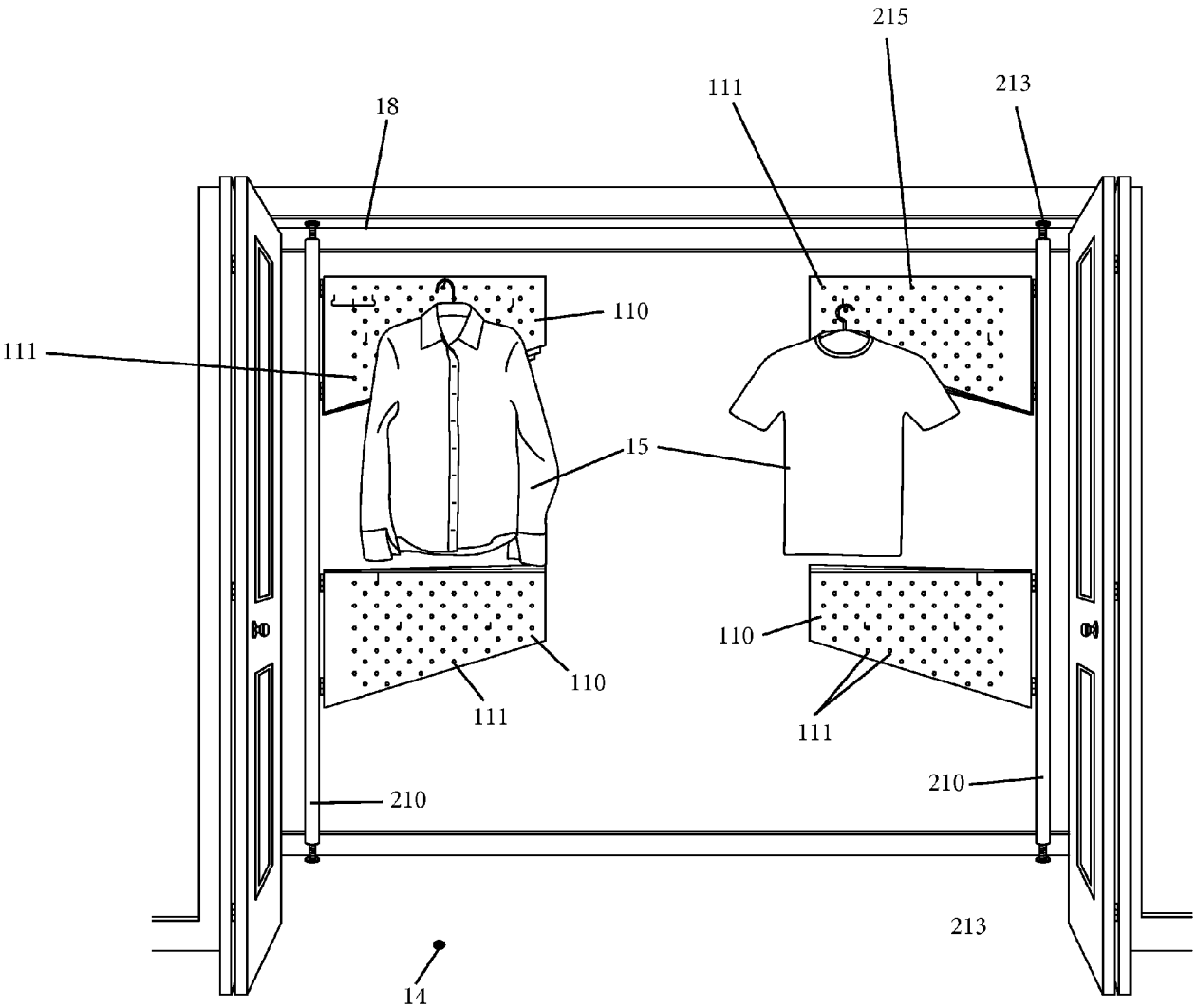
FIG. 2 is a front perspective view of a system that includes at least one pivotable support for clothing articles installed in a closet according to a second embodiment.

The hinge 150 is constructed to mount to another structure. The hinge 150 can thus include one or more plates 152 that mount to a support structure as described herein while allowing the base support 110 to pivot relative to the hinge 150. The plate 152 can be attached to the support structure using conventional means including the use of fasteners. FIGS. 1 and 2 illustrate the use of plates 152 to permit pivoting of the base supports 110. It will therefore be understood that at least in one embodiment, the pivotable support 100 comprised of the base support 110 and the hinge 150 can be mounted directly to a wall, such as one of walls 16 that define the closet 10.

In another embodiment that is shown in FIGS. 1-4C, the pivotable support 100 is not directly attached to a wall but instead is operatively coupled to a mount support 210 that is part of the system 200 and is constructed to be attached (mounted) to one of the walls 16 or to another structure such as a large piece of furniture or existing closet fixtures, etc.

FIG. 1 shows a plurality of pivotable supports 100 that are mounted to a single mount support 210 that is centrally located in the closet 10. In FIG. 2, there are two mount supports 210 that are spaced apart from one another. For example, one mount support 210 can be mounted in one corner of the closet 10 and the other mount support 210 can be mounted in the other corner. As described herein, the mount support 210 can be of the type that is directly attached to one wall as in FIG. 1 or can be of the type that extends between the ceiling and floor.

When the mount support 210 in FIG. 1 is secured to the back wall 16 using conventional techniques, such as brackets 211, the brackets 211 fix and secure the mount support 210 to the wall 16 and preferably, a plurality of brackets 211 are used along the length of the mount support 210 to securely fix the mount support 210. In the illustrated embodiment, there are two brackets 211. In FIG. 2, the mount support 210 can be secured to and between the ceiling 18 and the floor 14. For example, fasteners 213 can be disposed at the two opposing ends of the mount support 210 for securing the mount support 210 between the ceiling 18 and the floor 14. The fasteners 213 at the two ends can be of the same type of can be different. For example, one fastener 213 can be a bracket or the like that is fixedly attached to one of the ceiling 18 and the floor 14, while the other bracket 213 can be a telescoping foot that is adjustable. When a telescoping foot is used, the foot is rotated until the mount support 210 is securely held in place between the ceiling 18 and the floor 14.

The pivotable support 100 is configured to hold articles of clothing shown generally at 15. Unlike conventional organizers, the articles of clothing 15 can be held along both the first face 120 and the opposing second face 122 of the base support 110. Moreover, the articles of clothing 15 are not held substantially perpendicular to the longitudinal axis of the base support 110 but instead the clothing 15 is held generally parallel to the longitudinal axis of the base support 110. Each of the first and second faces 120, 122 of the base support 110 preferably includes a plurality of attachment points for clothing 15 and thus, multiple articles of clothing 15 can be held on each of the faces 120, 122. More particularly, each attachment point can hold a plurality of articles of clothing 15, such as a grouping or stack or bundle of clothing 15. The bundles of clothing 15 can be held in a side-by-side manner along the respective surface. In this manner, clothing 15 can be held along both the first face 120 and the second face 122. Such arrangement allows larger quantities of clothing 15 to be held on the base support 110.

It will be appreciated that the user can select whether and how to sort the clothing 15 in terms of its placement along one of the faces 120, 122. For example, clothing of one type (e.g., shirts) can be contained in one stack, while clothing of a different type (e.g., suits or coats or pants) can be contained in another stack. Alternatively, one or more stacks can include a mixed type of clothing.

The present invention can include different means for holding the clothing 15 along one face 120, 122 of the base support 110 in a suspended manner can be used. For example, a hook 215 can be used to hold the clothing 15 in a supported manner. The hook 215 includes a curved portion on which the cloths or hangers seat and an engagement portion which is coupled to the base support 110. In one embodiment, the base support 110 includes a plurality of openings or recesses 111 formed therein and the engagement portion 218 is designed to be received within one selected opening or recess 111. The opening 111 can be in the form of a through hole or it can be in the form of a hole which does not extend completely through the base support 110 (i.e., a recess). The engagement portion of the hook is thus constructed to be received within the opening or recess 111 and maintain its position therein when a load is placed thereon (i.e., when clothing is hung on the curved portion). The engagement portion is thus typically oriented perpendicular relative to the base support 110. The engagement portion can include barbs or other structures to assist in securely maintaining the engagement portion in the opening or recess 111 when a load is applied.

The openings or recesses 111 are formed along each of the faces 120, 122 of the base support 110 and can be formed according to a selected pattern. For example, the openings or recesses 111 can be formed according to rows and/or columns to allow the user to strategically place each hook 215 at a selected location. For example, it is intended that more than one hook 215 will be positioned along each face 120, 122. The hooks 215 do not have to be positioned in a linear manner in that the hooks 215 can be placed in different rows based on user selection and are to be placed in different columns so as to space the bundles of clothing apart. As mentioned herein, the bundles of clothing that are supported and hung on the base support 110 are spaced apart such that while there may be some overlap of the clothing, the clothing is still able to hang with the hooks 215 being horizontally oriented across the respective surface of the base support 110.

The hooks 215 can be formed of any number of different materials including but not limited to wood, plastic, metal, etc. It will be appreciated that the hooks 215 are constructed such that they can be easily inserted into and removed from the openings or recesses 111 to allow for repositioning of the clothing along the respective face 120, 122 of the base support 110. Since the hooks 215 can be placed on both faces 120, 122 of the base support 110, the one base support 110 can support a significant amount of clothing compared to conventional closet rod designs.

FIG. 3 shows the pivoting nature of the base supports 110 that allows the base supports 110 to be readily positioned in a wide variety of positions. It will be appreciated that the user can easily pivot one or more base supports 110 to allow the user to both place cloths on either of faces 120, 122 and remove clothing from said faces. It is intended that in a normal storage position, the base supports 110 can be at least substantially parallel to one another.

FIGS. 3-4C show another embodiment of the present invention in which a different mechanism for rotatably coupling the base supports 110 to the mount support 210 is shown. The mount support 210 can be in the form of an elongate rod. In this embodiment, the mount support 210 includes a plurality of annular shaped member 219 that are stacked and surround the mount support 210. The annular shaped members 219 are thus in the form of rings that surround the mount support 210. Each ring 219 includes a recessed slot 221 formed therein for securely attaching one base support 110. The recessed slots 221 can be keyed so that when an object is disposed therein, it can be locked in place.

The inner edge of the base support 110 includes a retaining member 119 that is inserted into the slot 221 for detachably attaching the base support 110 to the mount support 210. The retaining members 119 can be in the form of hooks or clips or the like. The clips 119 are inserted into the slots 221 so as to hang the base support 110.

Since the rings 219 are stacked along the length of the mount support 210, the rings 219 provide a number of different sites for attaching the base supports 110 along the mount support 210. In other words, each slot 221 provides an attachment point for the base support 110. Since each ring 219 can rotate independent from the other rings 219, the base supports 210 can be positioned in any number of different positions and at different angles relative to one another.

These rings 219 can be formed of any number of different materials including but not limited to plastics, metal, or other suitable materials.

The rings 219 can be of different sizes in that one ring can have a greater height than other rings.

Figure 7:
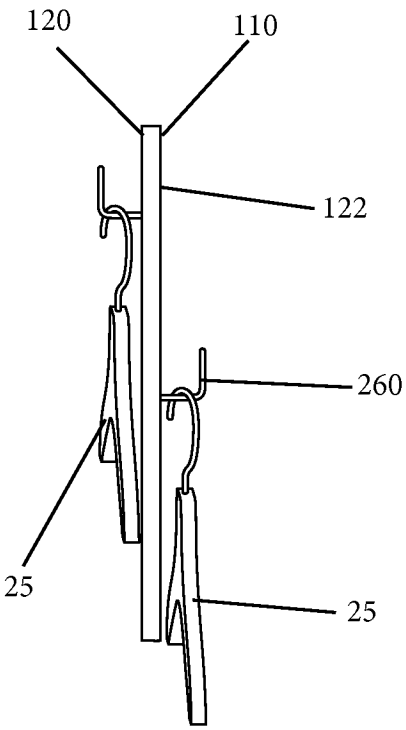
FIG. 7 is a side elevation view showing cloths hanging on both sides of the pivotable support.
Figure 6:
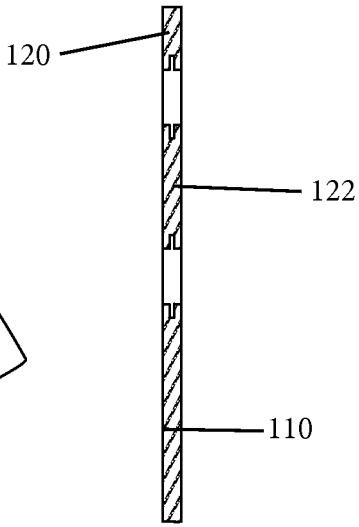
FIG. 6 is a cross-sectional view taken along the line 6-6 of FIG. 5.
Figure 5:
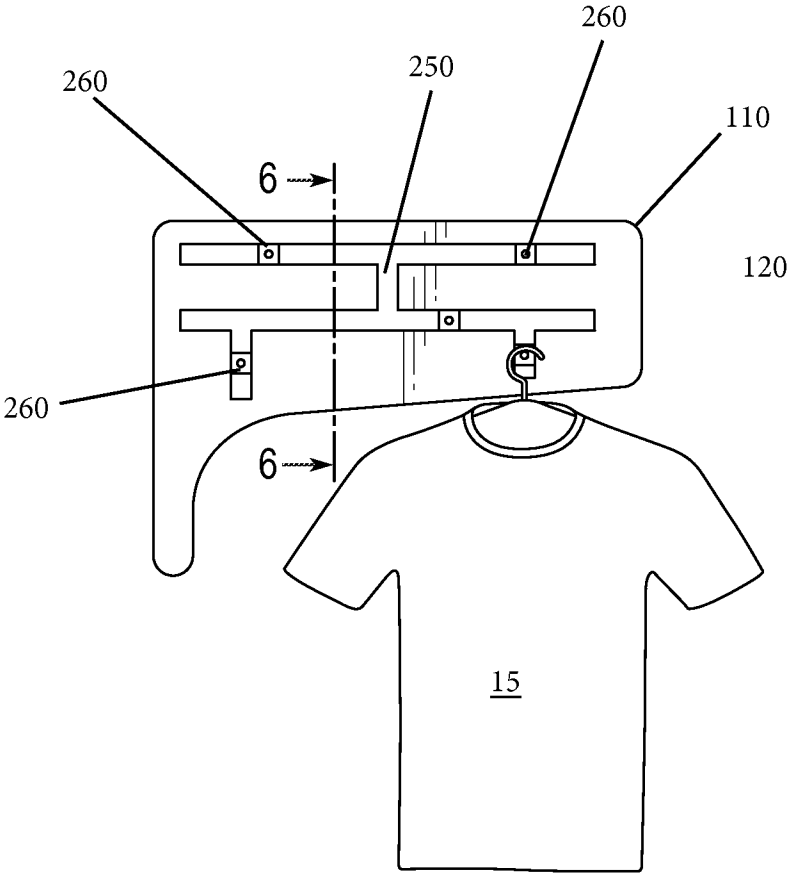
FIG. 5 is a pivotable support according to another embodiment.

Instead of placing a plurality of openings or recesses 111 in each surface of the base support 110 as shown in FIGS. 1 and 2, each face 120, 122 can include one or more tracks 250 in which one or more hooks 260 are disposed as shown in FIGS. 5-7. The track 250 is positioned along the respective surface of the base support 110. The track 250 can have any number of different shapes including both linear shapes and non-linear shapes. Generally, the track 250 is configured to act as a guide and define an area in which the hook can be disposed and define the degree of travel of the hook. There can be more than one track 250 per surface 120, 122 of the base support. Similar to the provision of openings 111 in the base support 110, the tracks 250 can be formed in rows and/or columns along the respective surface. The tracks 250 are typically independent and separated from one another; however, two tracks can be joined together to allow for the hook to be moved from one track to the other without having to disengage the hook 260.

The hook 260 is constructed to be disposed in multiple positions within the track 250. In other words, the user can select a specific location for the hook 260 depending upon different needs, such as the size and type of articles 15 being hung, etc. In the illustrated embodiment, the hook 260 can slidingly travel within and along the track 250. The hook 260 can includes a base which can including prongs or the like that allow the hook 260 be mated to the track 250 while allowing the sliding of the hook 260 within the track 250. The hook 260 has a hook structure that allows the articles 15 to be hung. FIG. 7 shows a hanger 25 being used to hang clothing 15 from hook 260.

As shown in FIG. 5, the track 250 can be in the form of a series of interconnected tracks and this allows the hook 260 to move both in a horizontal direction and in a vertical direction. FIG. 5 shows two main horizontal track section with a single vertical interconnection track section to allow the hook 260 to move from one main horizontal track section to the other.

Figure 8:
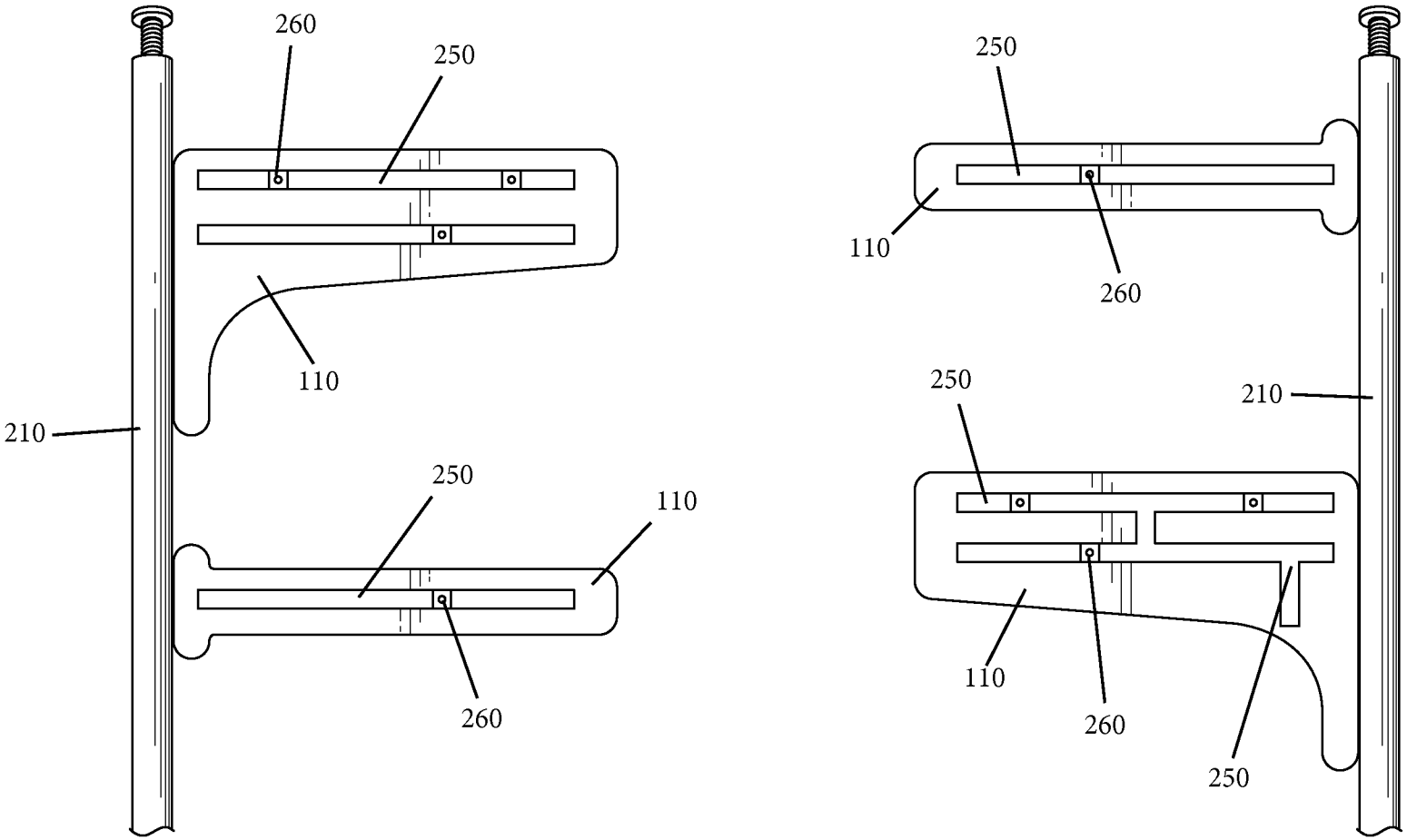
FIG. 8 is a side view of a system including a plurality of pivotable supports according to another embodiment.

FIG. 8 shows yet another embodiment showing a variety of different base portions 110. One base portion 110 includes a plurality of tracks 250 that are not interconnected, another base portion 110 contains only a single track and another base portion 110 includes an interconnected track network.

Figure 9:
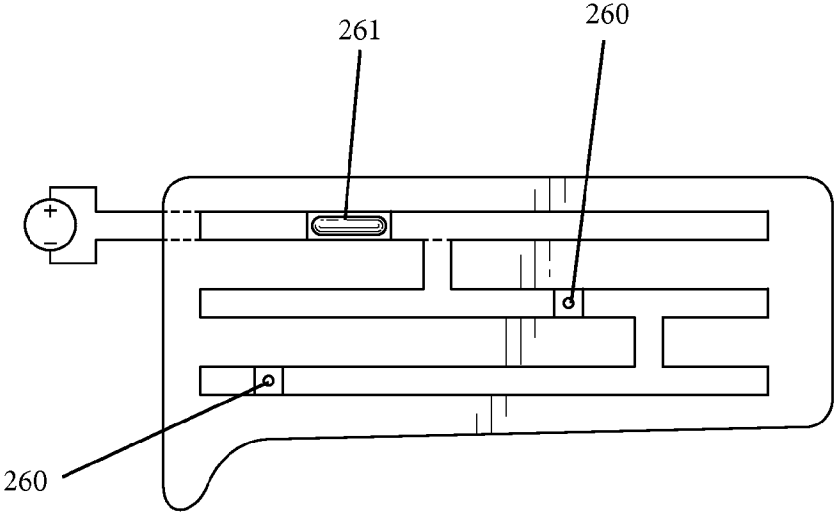
FIG. 9 is a side elevation view of a pivotable support including a light element.

It will also be understood that in the base supports that include one or more tracks, other structures besides hooks can be received and be capable of sliding movement within the track. For example, a light assembly 261 (FIG. 9) can be disposed within one track and configured to slidingly travel within the track in the same manner the hook 260 travels. The light assembly 261 can be of many different types including a manual type that is turned on and off by the user (as by pressing a button or flipping a switch) or can be an automatic type that turns on when a triggering event occurs, such as movement of the base portion 110 to which it is attached. The light assembly 261 can be moved along and within the track. The light assembly 261 is preferably battery powered.

Figure 10:
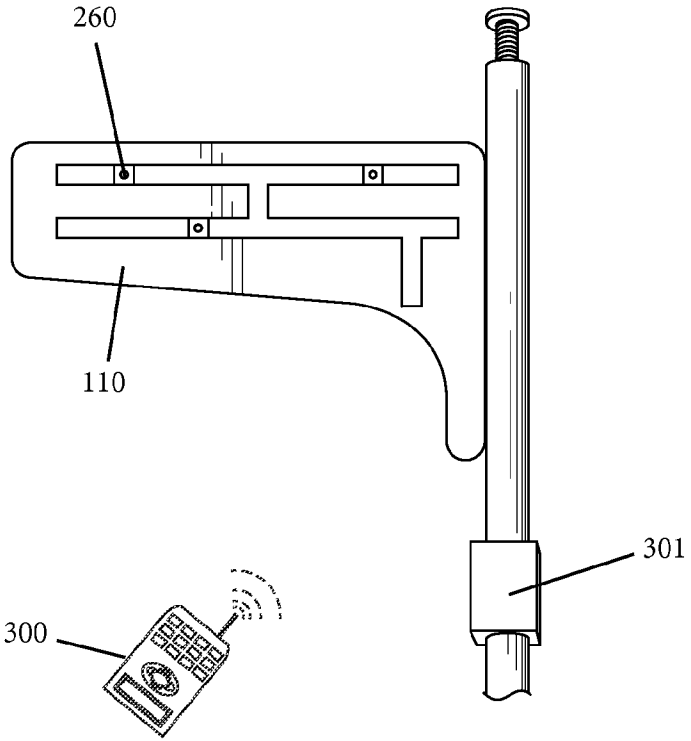
FIG. 10 is a side elevation view of a motorized system including at least one pivotable support.

FIG. 10 shows another embodiment in which the movement of the base portion 110 can be remotely controlled by the user. For example, a remote control 300 can be provided for use by the user to move (rotate) the base portion 110. For example, a motor or the like 301 can be provided and disposed along the vertical support and is operatively coupled to the base portion 110 to permit the rotation of the base portion 110 about the vertical support. For example, the remote control can be configured in any number of different manner including having a separate button for each of the base portions 110. Each base portion 110 can thus be rotated by the user pressing the appropriate button. Multiple buttons can be provided for each base portion 110 to rotate the base portion 110 in two opposite directions.

The various components described herein, including the base support 110, can be formed of any number of different materials including but not limited to wood, plastic, metal, etc.

The shapes of the base support 110 can vary as wells as the sizes thereof as illustrated in the present figures.

It will be appreciated that an support 100 produced in accordance with the present invention is intended to be installed at a target location, in this case a closet 10, as an aftermarket product. In other words and as described herein, the support 100 can be provided as a retrofitable product that is configured to be installed in an existing closet 10. FIG. 1 shows an exemplary closet 10 in the form of a walk-in closet that is defined by a floor 12, an opposing ceiling 14, a pair of opposing side walls 16 and a rear wall 18. A door or the like is typically opposite the rear wall 18 and provides an entrance into the closet 10. Any number of different types of doors or other structures to cover the entrance can be used or the entrance can be free of any structure and the user can freely walk into the closet 10.

The floor 12, ceiling 14, and walls 16, 18 can be formed of any suitable material, including dry wall for walls 16, 18 and ceiling 14 and wood, tile, cement, etc., for the floor 12.

In a traditional closet, a closet rod is mounted to and extends between the side walls 16 to provide a means for hanging clothing.

The closet 10 can include other structures to store items and in particular, can include shelving or the like to allow items to be placed and stored on shelves.

In accordance with the present invention, the organizer 100 can be provided as a kit that is to be installed by the user. The individual parts of the organizer 100 can thus be provided in a broken-down form (format) and be contained in a box.

Figure 11:
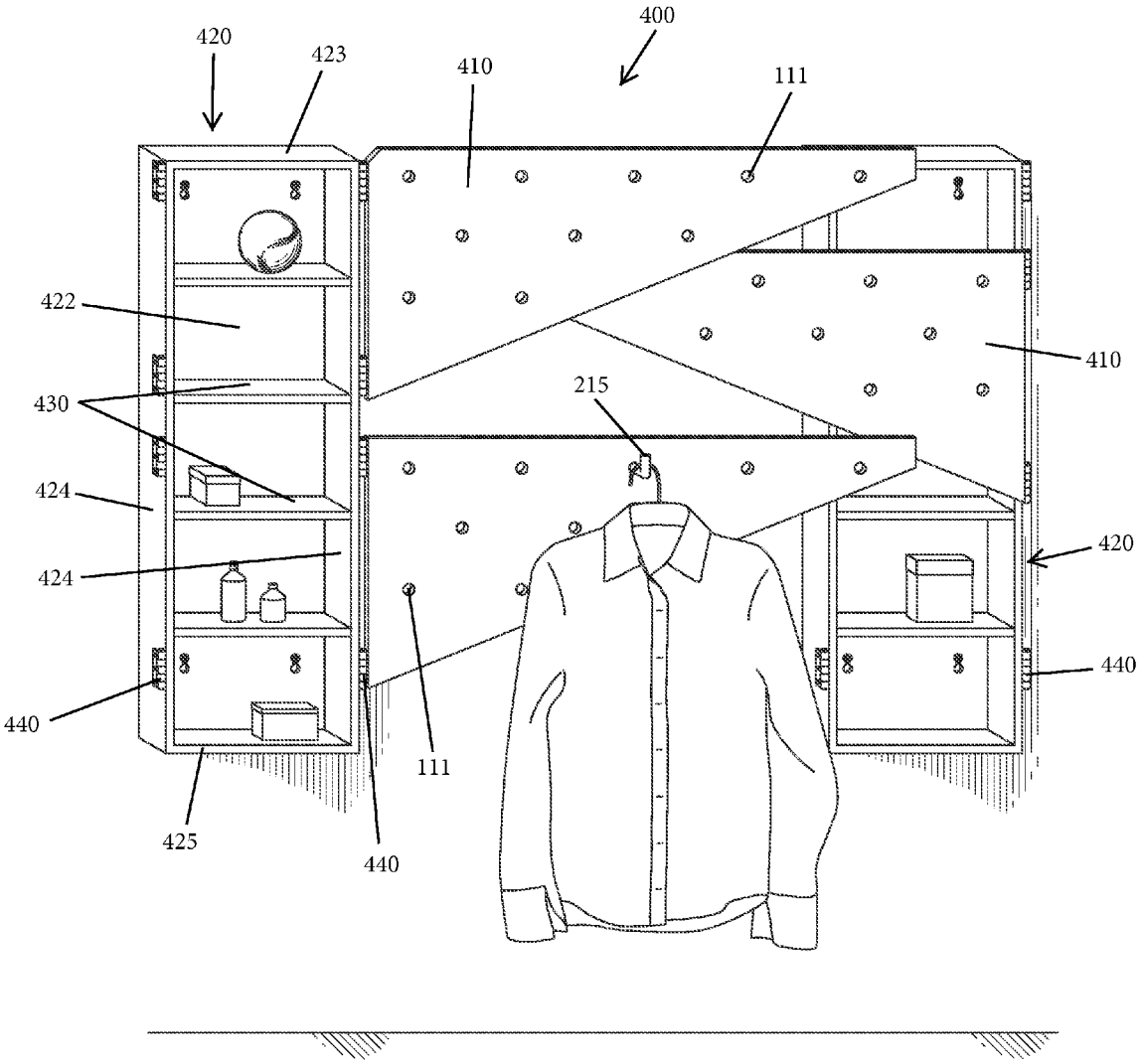
FIG. 11 is a front perspective view of an assembly (organizer) including a pivotable support according to another embodiment.

FIG. 11 is another system 400 is shown. The system 400 includes a plurality of pivotable supports 410 that are similar to or identical to the pivotable supports disclosed herein. A mount 420 is constructed to support and suspend the pivotable supports 410. In the illustrated embodiment, the mount 420 is in the form of a book case like structure in that the mount 420 has a rear wall 422 and two spaced apart side walls 424 that are attached to the rear wall 422. A top wall 423 and bottom wall 425 is also provide. The mount 420 includes one or more shelves 430 to define storage compartments in which items can be stored.

Along the front edge of the side walls 424, a plurality of hinges 440 or other type of mount hardware can be provided for pivotally coupling the pivotable supports 410 to the mount 420. As shown, the hinges 440 can be located on both the inner and outer side walls 424. For illustration purposes, FIG. 11 shows two mounts 420, namely, a left mount 420 and a right mount 420 and the left mount 420 has two pivotable supports 410 that are attached to the right side wall 424, while the right mount 420 has a single pivotable support 410 that is attached to the right side wall 424. The spacing of the mounts 420 is such that when the pivotable supports 410 pivot, they at least partially overlap.

The pivotable supports 410 can have any of the constructions described herein with reference to any of the figures that are a part hereof. In other words, the support 410 has a means for holding the clothing, such as hooks or tracks with movable hook elements are described herein. Clothing can be mounted to both the front and back surfaces of the support 410.

The mounts 420 are mounted to a planar support surface, such as a wall, using conventional hardware and techniques. For example, the mounts 420 can be mounted to the wall using brackets and/or fasteners.

The present is thus directed to a system by which cloths can be hung in a more efficient manner since each base support has a front and search surface configured to act as a surface on which cloths can be hung. In addition, the pivoting nature of each base support allows a plurality of base supports to be rotated into a position in which the base supports are at least substantially parallel to one another. Multiple base portions can be positioned at different heights relative to one another to provide for more base supports being oriented along the vertical supports.

What is claimed is:

1. An assembly for holding a plurality of clothing articles comprising:

a first mount that is configured to be fixedly attached to a support surface;

at least one pivotable support that is pivotally attached to the first mount, each pivotable support having a first face and an opposite second face;

at least one hook element for holding one or more clothing articles along one of the respective first or second faces, wherein each of the first and second faces is configured to receive and hold one or more hook elements;

wherein the first mount comprises an elongated pole that includes a plurality of rotatable rings disposed circumferentially around the elongated pole, each ring having a locking slot that is configured to receive a fastener formed along an inner edge of the pivotable support to thereby pivotally attach the pivotable support to the mount, wherein the each fastener comprises a hook that allows the pivotable support to be hung, each pivotable support having at least two spaced fasteners that are received into corresponding locking slots of two different rotatable rings that are space apart from one another;

a second mount that is configured to be fixedly attached to the support surface; and at least one pivotable support that is pivotally attached to the second mount, each pivotable support having a first face and an opposite second face, wherein each of the first and second faces has at least one hook element for holding one or more clothing articles along the respective first or second faces.

2. The assembly of claim 1, wherein each pivotable support has an inner edge that is pivotally attached to the first mount and an outer edge that is spaced from the first mount, wherein the inner edge has a greater height than the outer edge.

3. The assembly of claim 2, wherein each pivotable support has a top edge and an opposing bottom edge that extend between the inner and outer edges, the top and bottom edges being in a non-parallel arrangement.

4. The assembly of claim 1, further including at least one bracket for mounting the elongated pole in a vertical manner.

5. The assembly of claim 4, wherein the elongated pole has the bracket at one end and a telescoping leg at the opposite end to secure the pole to the mount surface.

6. The assembly of claim 1, wherein each of the first and second faces includes a plurality of openings each of which is configured to receive one hook element to allow a user to select a location for the hook element along one of the first and second faces.

7. The assembly of claim 1, wherein the rings are stacked vertically along the elongated pole to provide multiple attachment points for the at least one pivotable support.

8. The assembly of claim 1, wherein there are more than two pivotable supports pivotally attached to one mount.

9. The assembly of claim 1, wherein the first and second mounts are positioned relative to one another such that at least a distal portion of the pivotable support attached to the first mount overlaps a distal portion of the pivotable support attached to the second mount.

10. The assembly of claim 1, wherein the at least one pivotable support is triangular shaped.

11. The assembly of claim 1, wherein each ring has a through hole that extends completely through the ring from a top surface to a bottom surface and receives the elongated pole.

12. An assembly for holding a plurality of clothing articles comprising:

a first mount that is configured to be fixedly attached to a support surface;

at least one pivotable support that is pivotally attached to the first mount, each pivotable support having a first face and an opposite second face; and at least one hook element for holding one or more clothing articles along one of the respective first or second faces, wherein each of the first and second faces is configured to receive and hold one or more hook elements;

wherein the at least one pivotable support has a plurality of recessed tracks formed in each of the first and second faces, each track being configured to receive and hold the hook element such that the hook element can slidingly travel within the track to allow repositioning of the hook element along one of the first and second faces and wherein one of the first and second faces includes a plurality of recessed horizontal tracks that are spaced apart and parallel to one another and are interconnected with a recessed interconnector track to allow the hook element to slidingly travel from one recessed track to another recessed horizontal track.

13. The assembly of claim 12 , wherein the plurality of recessed tracks and the recessed interconnector track comprise through holes formed through the at least one pivotable support.

14. The assembly of claim 12, further including a light that is configured to slidingly travel and be held within the one of the plurality of recessed tracks.

15. An assembly for holding a plurality of clothing articles comprising:

a first mount that is configured to be fixedly attached to a support surface;

at least one pivotable support that is pivotally attached to the first mount, each pivotable support having a first face and an opposite second face; and at least one hook element for holding one or more clothing articles along one of the respective first or second faces, wherein each of the first and second faces is configured to receive and hold one or more hook elements;

wherein the first mount comprises an elongated pole that includes a plurality of rotatable rings disposed circumferentially around the elongated pole, each ring having a locking slot that is configured to receive a fastener formed along an inner edge of the pivotable support to thereby pivotall attach the pivotable support to the mount wherein the each fastener comprises a hook that allows the pivotable support to be hung, each pivotable support having at least two spaced fasteners that are received into corresponding locking slots of two different rotatable rings that are space apart from one another;

wherein the at least one pivotable support is operatively coupled to a remote controlled motor to allow for controlled rotation of the at least one pivotable support by a remote control.

* * * * *